US006854716B2

(12) United States Patent
Bronstad

(10) Patent No.: US 6,854,716 B2
(45) Date of Patent: Feb. 15, 2005

(54) CRASH CUSHIONS AND OTHER ENERGY ABSORBING DEVICES

(75) Inventor: Maurice E. Bronstad, San Antonio, TX (US)

(73) Assignee: TRN Business Trust, Dallas, TX (US)

( * ) Notice: Subject to any disclaimer, the term of this patent is extended or adjusted under 35 U.S.C. 154(b) by 33 days.

(21) Appl. No.: 10/455,710

(22) Filed: Jun. 5, 2003

(65) Prior Publication Data

US 2004/0016916 A1 Jan. 29, 2004

Related U.S. Application Data

(60) Provisional application No. 60/389,996, filed on Jun. 19, 2002.

(51) Int. Cl.[7] ..... A01K 3/00
(52) U.S. Cl. ..... 256/13.1
(58) Field of Search ..... 256/13.1, 1; 404/6, 404/7

(56) References Cited

U.S. PATENT DOCUMENTS

| | | | |
|---|---|---|---|
| 3,617,076 | A | 11/1971 | Attwood |
| 4,330,106 | A | 5/1982 | Chisholm |
| 4,655,434 | A | 4/1987 | Bronstad |
| 4,838,523 | A | 6/1989 | Humble et al. |
| 5,022,782 | A | 6/1991 | Gertz et al. |
| 5,078,366 | A | 1/1992 | Sicking et al. |
| 5,391,016 | A | 2/1995 | Ivey et al. |
| 5,503,495 | A | 4/1996 | Mak et al. |
| 5,765,811 | A | 6/1998 | Alberson et al. |
| 5,797,591 | A | 8/1998 | Krage |
| 5,851,005 | A | 12/1998 | Muller et al. |
| 5,876,020 | A | 3/1999 | Giavotto |
| 5,947,452 | A | 9/1999 | Albritton |
| 5,957,435 | A | 9/1999 | Bronstad |
| 5,967,497 | A | 10/1999 | Denman et al. |
| 6,022,003 | A | 2/2000 | Sicking et al. |
| 6,089,782 | A | 7/2000 | Bligh et al. |
| 6,092,959 | A | 7/2000 | Leonhardt et al. |
| 6,109,597 | A | 8/2000 | Sicking et al. |
| 6,126,144 | A | 10/2000 | Hirsch et al. |
| 6,129,342 | A | 10/2000 | Bronstad |
| 6,142,452 | A | 11/2000 | Denman et al. |
| 6,168,346 | B1 | 1/2001 | Ernsberger |
| 6,173,943 | B1 | 1/2001 | Welch et al. |

(List continued on next page.)

FOREIGN PATENT DOCUMENTS

| | | |
|---|---|---|
| EP | 0431780 A2 | 6/1991 |
| EP | 0872594 A2 | 10/1998 |

OTHER PUBLICATIONS

U.S. Department of Transportation Federal Highway Administration "Technical Advisory—Guardrail Transitions" at internet address <http://www.fhwa.dot.gov/////// legsregs/directives/techadvs/t504034,htm> 12 pages, Jun. 8, 1993.

U.S. Appl. No. 10/175,366 entitled "Impact Assembly for an Energy Absorbing Device" filed Jun. 19, 2002 by Bronstad, Jun. 19, 2002.

*Primary Examiner*—John Cottingham
(74) *Attorney, Agent, or Firm*—Baker Botts L.L.P.

(57) ABSTRACT

A crash cushion having a plurality of beams extending substantially parallel to one another. One end of the crash cushion may be slidably coupled with one end of a traffic barrier. Another end of the crash cushion faces oncoming traffic. A plurality of support posts are coupled to and support the plurality of beams. Forceful impact of a vehicle with the end of the crash cushion facing oncoming traffic results in energy absorption during telescoping of the beams relative to the traffic barrier. A method of manufacturing crash cushions and other energy absorbing devices is provided.

16 Claims, 9 Drawing Sheets

U.S. PATENT DOCUMENTS 6,220,575 B1 4/2001 Lindsay et al.
6,293,727 B1 9/2001 Albritton
6,299,141 B1 10/2001 Lindsay et al.
6,308,809 B1 10/2001 Reid et al.
6,409,417 B1 * 6/2002 Muller et al. ..... 256/13.1 X
6,530,560 B2 3/2003 King
6,644,888 B2 11/2003 Ochoa
2003/0034484 A1 2/2003 Buth et al.
2003/0057410 A1 * 3/2003 Denman et al. ..... 256/13.1
2003/0168650 A1 * 9/2003 Alberson et al. ..... 256/13.1

* cited by examiner

CRASH CUSHIONS AND OTHER ENERGY ABSORBING DEVICES

RELATED APPLICATION

This application claims the benefit of previously filed provisional patent application Ser. No. 60/389,996 entitled "Crash Cushions And Other Energy Absorbing Devices" filing date Jun. 19, 2002.

TECHNICAL FIELD OF THE INVENTION

The invention relates to energy absorbing devices which may be used along a shoulder of a roadway or a median to protect motorists from hazards such as the end of a guardrail or concrete barrier, bridge piers, abutments, sign posts and other hazards.

BACKGROUND OF THE INVENTION

Guardrail systems are one example of traffic barriers placed along roadsides to screen errant vehicles from hazards behind the barrier. Guardrail systems are frequently constructed using steel W-beams mounted on wood or steel posts. Thrie beams may also be used as a guardrail system. Both W-beams and thrie beams function primarily in tension to redirect an impacting vehicle. Therefore, the ends of a typical guardrail system are securely anchored to allow the associated beams to develop desired tensile forces. In addition, since the ends of a guardrail system represent a discontinuity in the barrier, the end facing oncoming traffic is subject to being struck "head-on" by vehicles with small departure angles from an adjacent roadway. When struck in this manner, the end of the guardrail may spear the vehicle. One widely used, but now obsolete, end terminal design "buried" a W-beam at the end of the guardrail facing oncoming traffic to eliminate spearing.

Various types of highway safety devices are often disposed at the end of guardrail systems and other traffic barriers. Examples include guardrail end terminals, barrels filled with sand and crash cushions. Highway agencies have used crash cushions at high accident locations for a number of years. Crash cushions are generally provided to absorb the energy of head-on impacts with decelerations that are not life threatening for design conditions. Because the number of guardrail systems is quite large and impact probability is low for the end of most guardrail systems, many states often do not have sufficient resources to employ crash cushions at the end of all guardrail systems because of the associated expense.

Development of guardrail end terminals and crash cushion designs is complicated by the need to minimize resistance to small car impacts while still providing necessary energy absorbing capability for full-size car impacts. Such impacts may occur with the end or downstream from the end of a guardrail system or other traffic barrier. U.S. Pat. Nos. 4,655,434 and 5,957,435 to Maurice E. Bronstad, disclose guardrail end terminals having beams with spaced openings to absorb kinetic energy of an impacting vehicle.

The use of traffic barriers and particularly concrete barriers has become more common with respect to gore areas. The terms "gore" and "gore area" may be used to describe land where two roadways diverge or converge. A gore is typically bounded on two sides by the edges of the roadways which join at the point of divergence or convergence. Traffic flow is generally in the same direction on both sides of these roadways. The gore area generally includes shoulders or marked pavement, if any, between the roadways.

Additionally, a gore area may extend sixty (60) meters (approximately two hundred (200) feet) from the point of divergence or convergence.

SUMMARY OF THE INVENTION

In accordance with teachings of the present invention disadvantages and problems associated with previous energy absorbing systems have been substantially reduced or eliminated. One aspect of the present invention includes a crash cushion having a pair of beams, extending substantially parallel to one another. One other end of each beam may be respectively attached to opposite sides of a traffic barrier. A plurality of openings and lands may be formed in the beams to encounter a plurality of fasteners during a vehicle impact to absorb the associated kinetic energy. Metal strips or lands disposed between adjacent openings may be varied in length accordance with the present invention to provide desired energy absorbing characteristics.

One feature of the present invention includes a mechanism and method for absorbing energy from a vehicle impacting with one or more energy absorbing members of a crash cushion. The energy absorbing mechanism includes shredding strips or lands disposed between a series of openings or slots formed in energy absorbing members. Various types of beams may be used to form an energy absorbing device incorporating teachings of the present invention. For one embodiment, a substantially square wave of energy absorption may be generated by movement of the energy absorbing members during impact of a vehicle with the end of the crash cushion facing oncoming traffic.

Another aspect of the present invention includes a crash cushion having an upstream end with a nose assembly facing oncoming traffic. A first support post may be disposed adjacent to the nose assembly. One or more cable anchor assemblies may be attached to the first support post and respective energy absorbing members to apply tension thereto.

BRIEF DESCRIPTION OF THE DRAWINGS

A more complete understanding of the invention and its advantages will be apparent from the following written description taken in conjunction with the accompanying drawings in which.

DETAILED DESCRIPTION OF THE INVENTION

Figure 1:
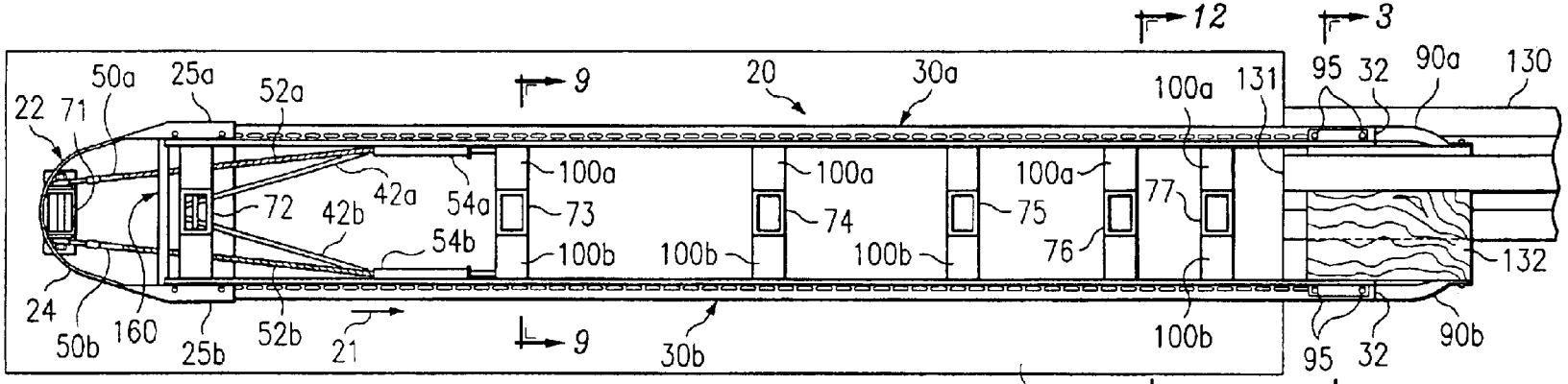
FIG. 1 is a schematic drawing with portions broken away showing a plan view of a crash cushion incorporating teachings of the present invention.

Preferred embodiments of the present invention and its advantages are best understood by referring to FIGS. 1–16 of the drawings, like numerals being used for like and corresponding parts of the various drawings.

Crash cushion 20 and associated components as shown in FIGS. 1–16 represent only one example of an energy absorbing device which may be formed in accordance with teachings of the present invention. For certain embodiments, crash cushion 20 may be adapted for attachment to upstream end 131 of traffic barrier 130 facing oncoming traffic. Such applications may include off ramps or lane dividers in a roadway where traffic flow may be in only one direction relative to crash cushion 20 and traffic barrier 130. Arrows 21 indicate the direction of normal traffic flow when crash cushion 20 and barrier 130 are used in a median with traffic in opposing direction. For other applications, such as an off ramp or lane divider, traffic flow will be in the same direction adjacent to each side of traffic barrier 130. Various aspects of the present invention will be described with respect to traffic flow in opposing directions relative to crash cushion 20. However, crash cushions incorporating teachings of the present invention may be used adjacent to gore areas and with other traffic flow patterns.

Traffic barrier 130 may be a conventional concrete highway barrier. Crash cushions and other types of energy absorbing devices formed in accordance with teachings of the present invention may be used with a wide variety of traffic barriers, roadway safety systems and hazard protection equipment. The present invention is not limited to use with traffic barriers such as shown in FIGS. 1–16.

Energy absorbing members may be formed in accordance with teachings of the present invention to fully absorb kinetic energy of an impacting vehicle (not expressly shown) with optimum deceleration to protect occupants of the vehicle and at the same time prevent the vehicle from impacting an associated traffic barrier or other hazard. The terms "energy absorbing member" and "energy absorbing members" may be used to define a thrie beam, W-beam or any other structure having a pattern of openings with intermediate material disposed between adjacent openings in accordance with teachings of the present invention. The terms "land" and "lands" may be used to define intermediate material disposed between adjacent openings formed in an energy absorbing member in accordance with teachings of the present invention.

Crash cushion 20 may include nose assembly 22, energy absorbing members 30, cable anchor assemblies 50, support posts 71 through 77 and beam connectors 90. For purposes of describing various features of the present invention, energy absorbing members 30 have been designated 30*a* and 30*b*. Cable anchor assemblies 50 have been designated 50*a* and 50*b*. Beam connectors 90 have been designated 90*a* and 90*b*. For crash cushion 20 energy absorbing members 30*a* and 30*b*, cable anchor assemblies 50*a* and 50*b* and beam connectors 90*a* and 90*b* may have substantially the same configuration and dimensions. For some applications, an energy absorbing device may be formed in accordance with teachings of the present invention with only one energy absorbing member or more than two energy absorbing members. The energy absorbing members may have substantially the same configuration or may have different configurations. Also, an energy absorbing device may be formed in accordance with teachings of the present invention with only one cable anchor assembly and one beam connector. For some applications, the cable anchor assemblies and the beam connectors may have different configurations and dimensions.

Crash cushion 20 may be used to prevent a vehicle (not expressly shown) from impacting with end 131 of traffic barrier 130. Crash cushion 20 is preferably capable of absorbing energy from a vehicle impact with nose assembly 22 while providing desired protection for occupants of the vehicle. Crash cushion 20 may also be capable of redirecting a vehicle which impacts with energy absorbing member 30*a* or 30*b* downstream from nose assembly 22, sometimes described as a "rail face" impact. For the embodiment shown in FIG. 1, traffic flow may be in opposite directions relative to energy absorbing members 30*a* and 30*b*. See arrows 21. For other applications, traffic flow may be in the same direction relative to both energy absorbing members 30*a* and 30*b*.

Nose assembly 22 may be attached to the upstream end or the first end of crash cushion 20 facing oncoming traffic. For the embodiment represented by crash cushion 20, nose assembly 22 includes generally curved portion 24 which surrounds first post 71. Side plates 25*a* and 25*b* may be used to couple curved portion 24 with second post 72 and energy absorbing members 30*a* and 30*b*. Nose assembly 22 may be formed from various materials which are satisfactory for wrapping around or bending around first post 71 such as twelve (12) gauge steel associated with highway guardrails. For other applications curved portion 24 and side plates 25*a* and 25*b* may be formed from various types of light weight material, including but not limited to, thin sheet metal, fiberglass, and other plastic or composite materials satisfactory for use with a highway safety system. Curved portion 24 and side plates 25*a* and 25*b* may be formed as a single integrated unit. For other applications, curved portion 24 and side plates 25*a* and 25*b* may be formed as separate components which are mechanically fastened with each other to form nose assembly 22.

Nose assembly 22 may provide only limited protection for first post 71 and cable anchor assemblies 50*a* and 50*b*. For crash cushion 20, nose assembly 22 does not provide substantial energy absorbing capability during a vehicle impact. A wide variety of nose assemblies may be satisfactorily used with an energy absorbing device formed in accordance with teachings of the present invention. For some applications a nose assembly may not be necessary. The present invention is not limited to use with nose assembly 22.

As shown in FIG. 1, energy absorbing members 30*a* and 30*b* preferably extend from end 131 of traffic barrier 130 substantially parallel with each other and spaced from each other. Energy absorbing member 30*a* and 30*b* have respective first ends 31 opposing oncoming traffic relative to one side of crash cushion 20. Respective second ends 32 are coupled with traffic barrier 130. For some applications, second end 32 of energy absorbing member 30*a* may be slidably coupled with traffic barrier 130 proximate end 131 using beam connector 90*a*. Spacer block 132 may be attached to the opposite side of traffic barrier 130 using various techniques (not expressly shown) satisfactory for use with highway safety systems. End 32 of energy absorbing member 30*b* may be slidably coupled with spacer block 132 using beam connector 90*b*.

Figure 14:
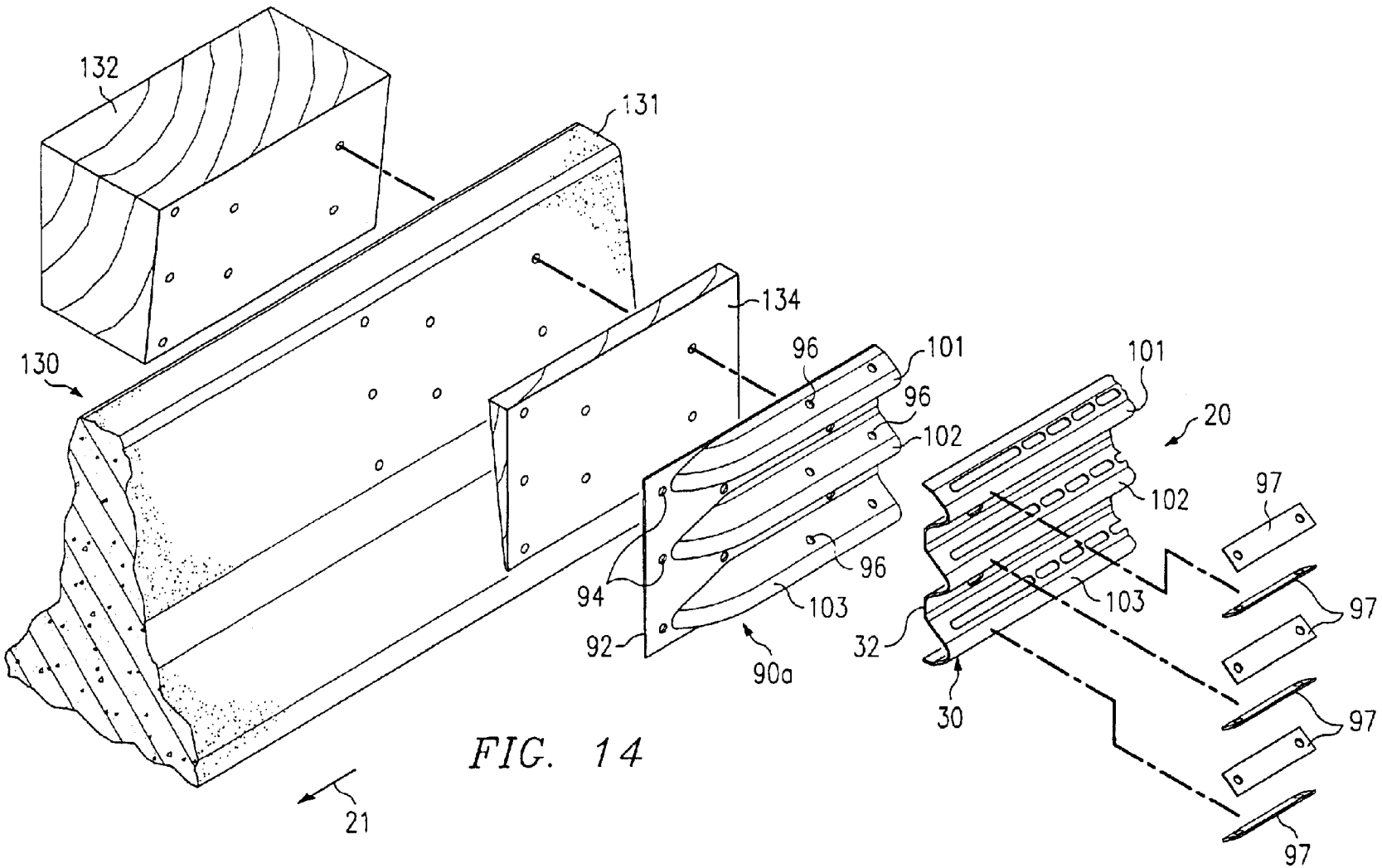
FIG. 14 is a schematic drawing showing an exploded, isometric view with portions broken away of one example of a crash cushion attached to a traffic barrier in accordance with teachings of the present invention.
Figure 16:
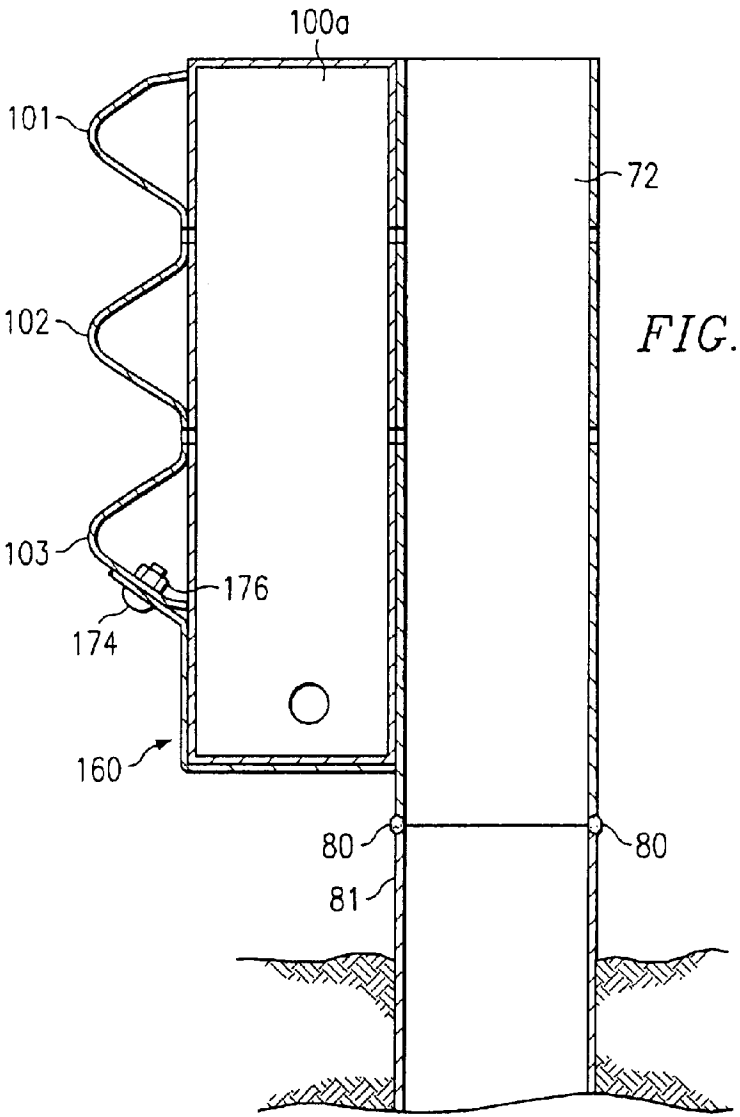
FIG. 16 is a schematic drawing in section taken along lines 16—16 of FIG. 15 showing one example of a support post mounted to base
Figure 15:
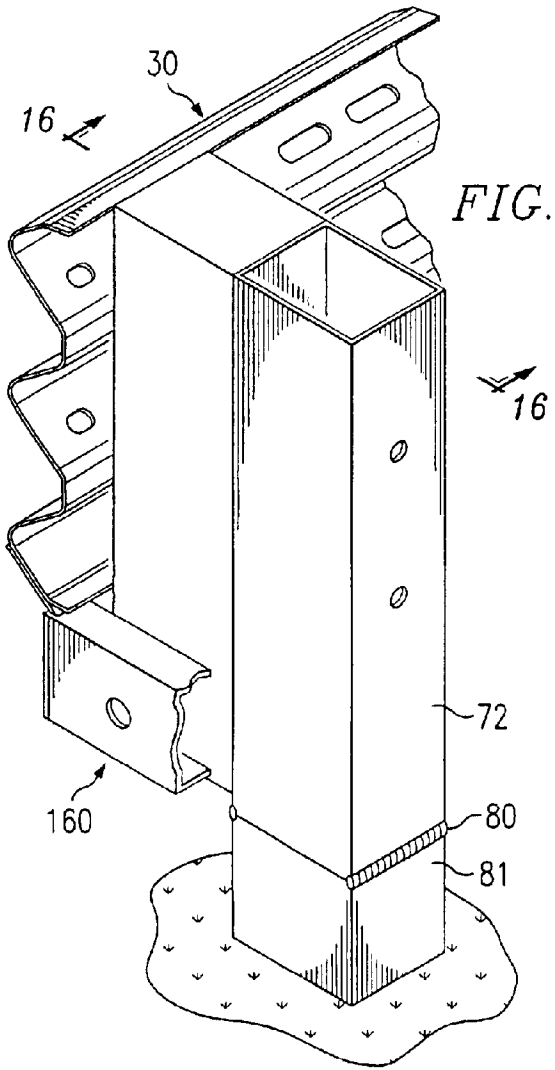
FIG. 15 is a schematic drawing showing a perspective view of a support post in accordance with the teachings of the present invention.

Depending upon the configuration of highway barrier 131 and the direction of adjacent traffic flow, an additional spacer block 134, as shown in FIG. 14, may be disposed between beam connector 90*a* and adjacent portions of highway barrier 130. If traffic barrier 130 and crash cushion 20 are located in a median between roadways with traffic flow in opposite directions, spacer block 134 may not be required to minimize possible snagging of a vehicle impacting with the side of traffic barrier 130. Alternatively, one or more edges of spacer block 134 may be tapered to minimize possible snagging of an impacting vehicle.

The dimensions and configuration of spacer block 132 and/or 134 may be selected based on desired spacing between energy absorbing members 30*a* and 30*b*, the configuration of traffic barrier 130 and other characteristics of an associated roadway (not expressly shown) and any adjacent hazard (not expressly shown). Spacer blocks 132 and 134 are shown as being manufactured from wood. However, various types of metals, plastics, and composite materials may be satisfactorily used to form spacer blocks 132 and 134.

Energy absorbing members 30*a* and 30*b*, as shown in FIGS. 1, 2, 3 and 9–12, may be generally described as a "thrie beam". As discussed later in more detail, a thrie beam typically includes three corrugations. For some applications, an energy absorbing device may be formed in accordance with teachings of the present invention using energy absorbing members having the configuration of a typical W-beam (two corrugations). However, the present invention is not limited to use with energy absorbing members having the configuration of a thrie beam or a W-beam.

Beam connectors 90*a* and 90*b* have a general configuration compatible with a thrie beam. However, other types of beam connectors may be satisfactorily used to slidably attach an energy absorbing member with a traffic barrier in accordance with teachings of the present invention. The present invention is not limited to use with beam connectors 90*a* and 90*b*.

For some applications, the end of an associated traffic barrier may have a configuration and dimensions such that energy absorbing members 30*a* and 30*b* of crash cushion 20 may be attached thereto without the use of a spacer block. Depending upon the configuration of highway barrier 131, additional spacer block 134 may be disposed between beam connector 90 and adjacent portions of highway barrier 130.

For some applications, energy absorbing members 30*a* and 30*b* may have a length of approximately nineteen (19) feet. One of the advantages of the present invention includes the ability to increase or decrease the length of an energy absorbing member while maintaining desired energy absorbing characteristics. Therefore, an energy absorbing device may be formed in accordance with the teachings of the present invention having an overall length either longer than or shorter than crash cushion 20.

Figure 10:
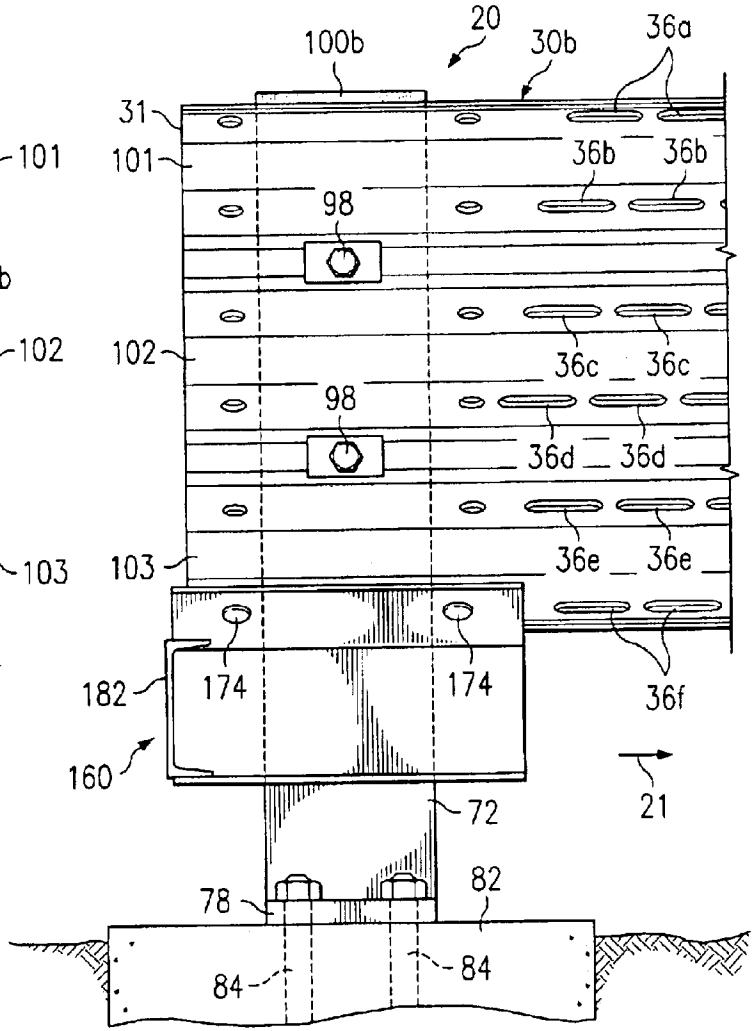
FIG. 10 is a schematic drawing in elevation with portions broken away showing a side view of the second support post and attached beam of FIG. 9.
Figure 9:
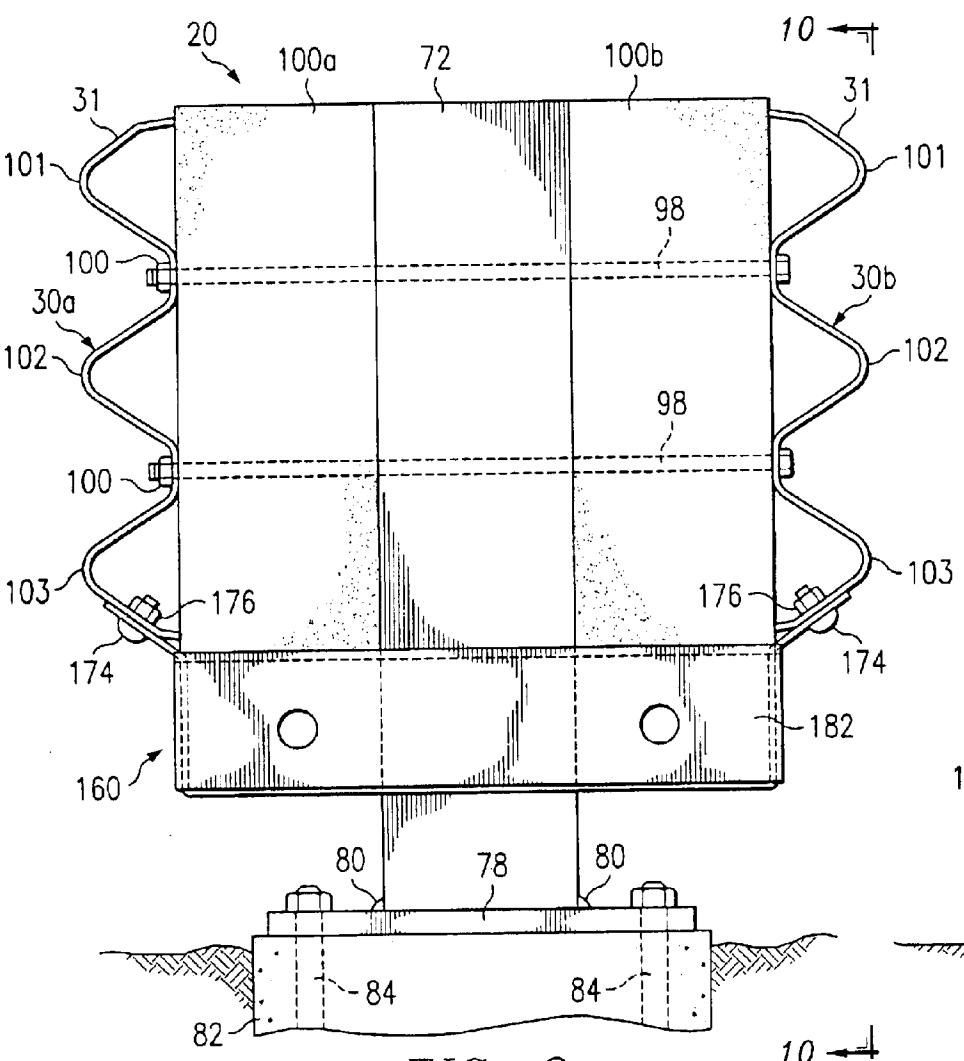
FIG. 9 is schematic drawing in section with portions broken away taken along lines 9—9 of FIG. 1 showing a second support post satisfactory for use with a crash cushion formed in accordance with teachings of the present invention.
Figure 11:
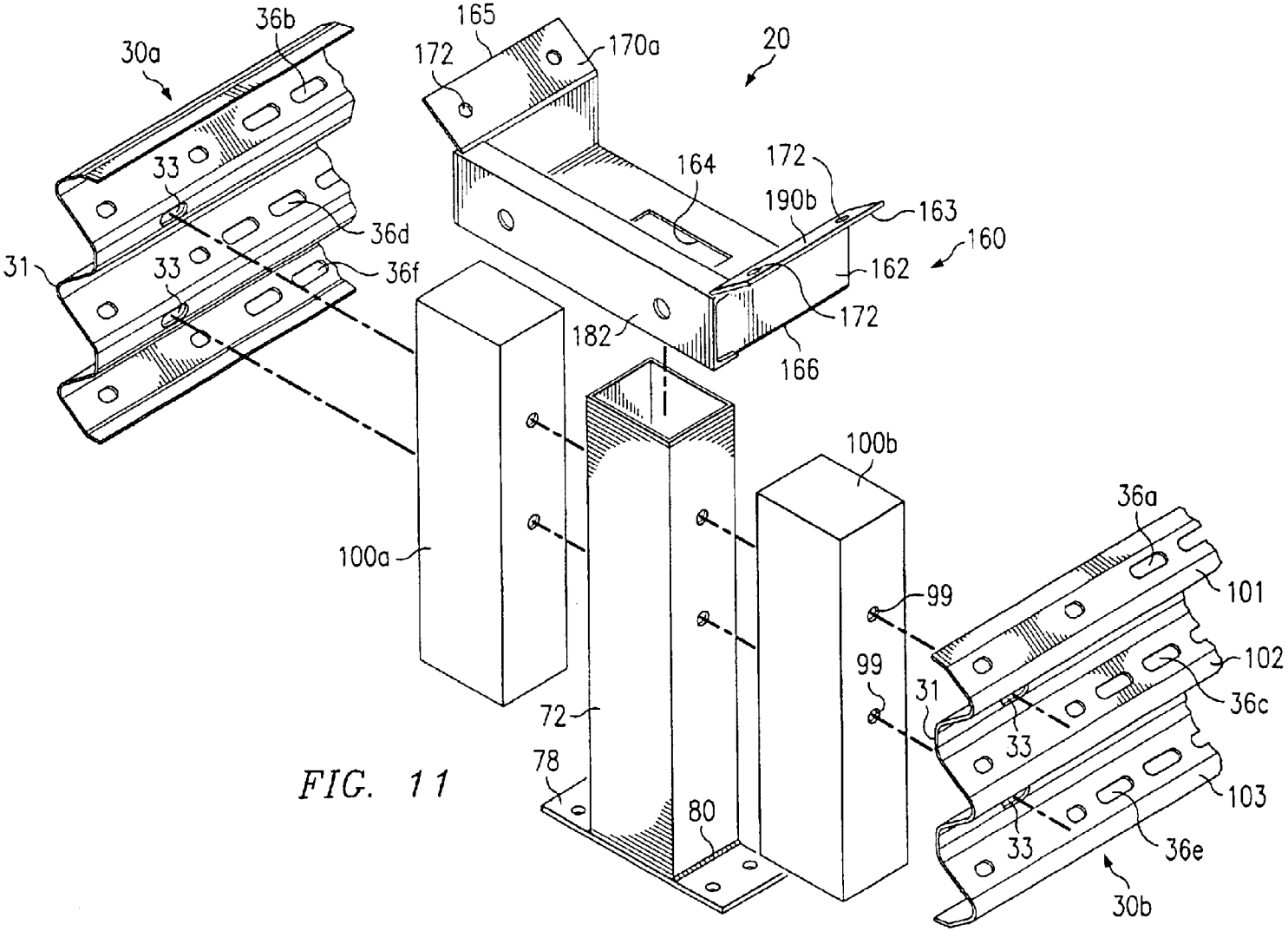
FIG. 11 is a schematic drawing showing an exploded view with portions broken away of the impact assembly and the second support post of FIG. 9.

As shown in FIGS. 1, 2, 9, 10 and 12 energy absorbing members 30*a* and 30*b* are preferably coupled with and supported by posts 72–77. Referring to FIGS. 9 and 10, second post 72 is preferably securely attached to first end 31 of each energy absorbing member 30*a* and 30*b*. An impact assembly such as shown in FIGS. 9, 10, and 11 may also be securely attached to second post 72. Energy absorbing members 30*a* and 30*b* may be slidably coupled with support posts 73–77 to facilitate telescoping movement of energy absorbing members 30*a* and 30*b* relative to support posts 73–77 and traffic barrier 130 during a vehicle impact with nose assembly 22.

During a vehicle impact with nose assembly 22, first post 71 will preferably breakaway to release tension associated with anchor cable assembly 50, allowing an impacting vehicle to engage second post 72, impact assembly 160 and attached energy absorbing members 30*a* and 30*b*. Depending upon the force or kinetic energy of an impacting vehicle, support posts 72–77 may also breakaway or collapse allowing energy absorbing members 30*a* and 30*b* to telescope relative to traffic barrier 130. The kinetic energy of an impacting vehicle will determine the number of posts 72–77 which are broken away and the amount of telescoping of energy absorbing members 30*a* and 30*b* relative to first end 131 of traffic barrier 130.

Cable anchor assemblies 50*a* and 50*b* preferably include respective cables 52*a* and 52*b* and cable anchor brackets 54*a* and 54*b*. Various types of cables such as wire rope may be used to form a cable anchor assembly satisfactory for use with the present invention. The first end of each cable 52*a* and 52*b* may be releasably secured proximate the associated ground line at the first end of crash cushion 20. The second end of each cable may be attached to respective cable anchor brackets 54*a* and 54*b*. Cable anchor brackets 54*a* and 54*b* may be releasably engaged with respective energy absorbing member 30*a* and 30*b*.

Cable anchor assemblies 50*a* and 50*b* provide sufficient tension to respective energy absorbing member 30*a* and 30*b* to withstand a rail face impact downstream from nose assembly 22. For the embodiments shown in FIGS. 4*a*–6*b* a vehicle impact with nose assembly 22, will cause post 71 to break away and release tension associated with cable anchor assemblies 50*a* and 50*b*. The first end of cables 52*a* and 52*b* may be releasably secured proximate the ground line using mechanisms other than first post 71. Cable anchor brackets 54*a* and 54*b* may disengage from respective energy absorbing members 30*a* and 30*b* as strut members 42*a* and 42*b* attached to post 72 push against cable anchor brackets 54*a* and 54*b*. For some applications, strut members 42*a* and 42*b* may be disposed between first post 71 and second post 72 to disengage cable anchor brackets 54*a* and 54*b* from respective energy absorbing members 30*a* and 30*b* during an end on impact with nose assembly 22.

For embodiments of the present invention such as shown in FIGS. 2, 9, 10 and 12, posts 71–77 may be generally described as breakaway support posts. For some applications concrete foundation or concrete footing 82 may be disposed adjacent to end 131 of traffic barrier 130 extending in the direction of oncoming traffic. A set of four bolts 84 are preferably securely disposed in concrete foundation 82 at desired locations for respective support posts 71–77. Each support post 71–77 may include a respective base plate 78. Four openings (not expressly shown) may be placed within each base plate 78 to receive respective bolts 84. Nuts 86 may be used to secure base plates 78 and associated support post 71–77 with respective bolts 84. Various types of mechanical fasteners other than bolts 84 and nuts 86 may be satisfactorily used to secure support post 71–77 with concrete foundation 82. The present invention is not limited to use with concrete foundation 82 or bolts 84 and nuts 86.

Figure 12:
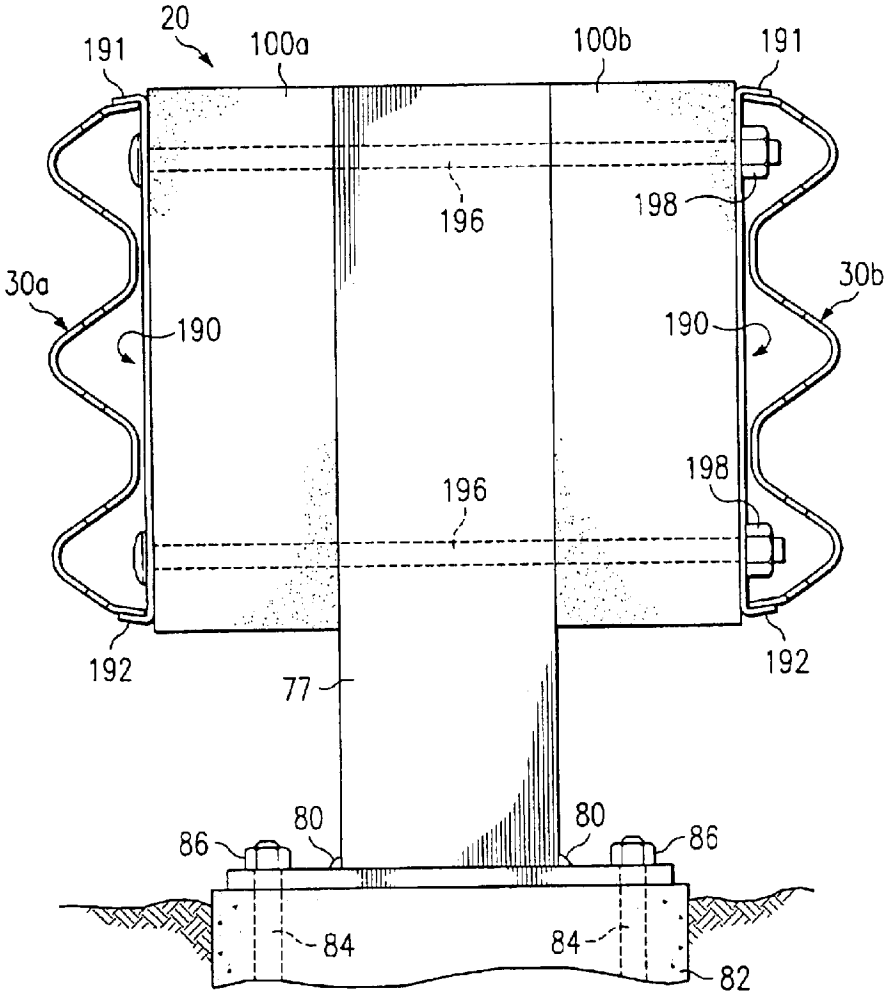
FIG. 12 is a schematic drawing in section taken along lines 12—12 of FIG. 1 showing one example of a support post and a pair of beams slidably coupled with each other in accordance with teachings of the present invention.

As shown in FIGS. 9, 11 and 12, each post 71–77 may be attached to respective base plate 78 by a pair of welds 80. Posts 71–77 may be mounted on foundations 82 with welds 80 extending generally parallel with the direction of traffic flow as indicated by arrow 21. In another embodiment, referring to FIGS. 15 and 16, posts 71–77 may also be mounted onto base column 81 that has been inserted into the ground. Base column 81 may be preferably mounted in the ground with the use of concrete. However, base column 81 may be placed in direct communication with the ground or retained by other means including mechanical.

Posts 71–77 may attach to base column 81 with welds 80 placed substantially parallel to the direction of traffic flow. Welds 80 cooperate with each other and respective mounting base to provide sufficient strength for support posts 71–77 to resist a rail face impact. During a vehicle impact with nose assembly 22, posts 71–77 may be designed to fail preferably along welds 80 and separate from their respective mounting base.

FIGS. 4*a*–6*b* show various examples for attaching cable anchor assemblies 50*a* and 50*b* with first post 71 of crash cushion 20. Other mechanisms may also be used. Post 71 may include a generally elongated, hollow tube having a generally rectangular cross section. As previously noted, base plate 78 may be attached with one end of post 71 using a pair of welds 80. For the embodiment represented by crash cushion 20, respective bolts 84 and nuts 86 may be used to attach post 71 at a desired location on foundation 82.

Figure 4A:
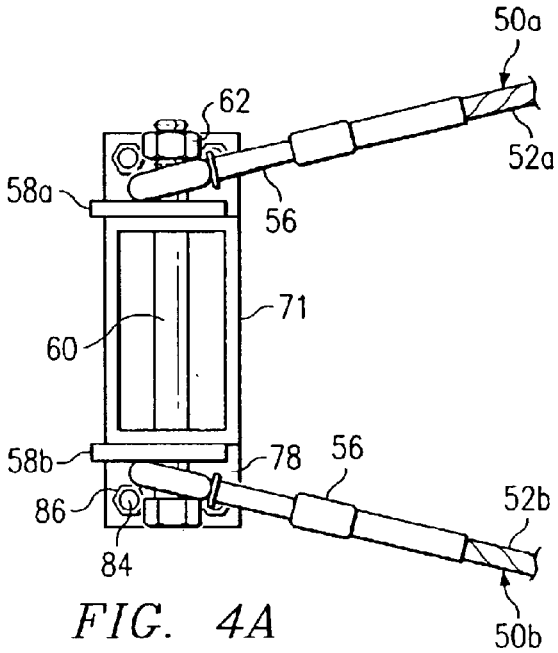
FIG. 4A is a schematic drawing showing a plan view with portions broken away of a first post or anchor post with attached cables satisfactory for use with a crash cushion incorporating teachings of the present invention.
Figure 5A:
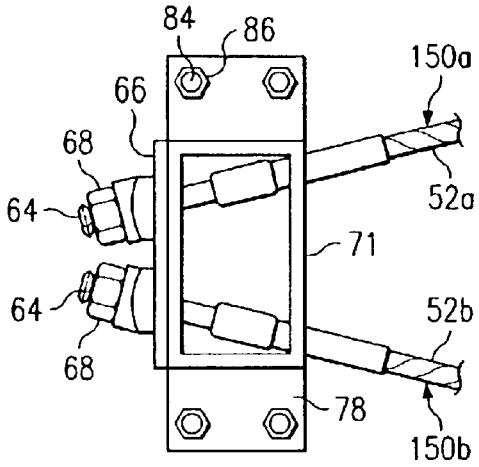
FIG. 5A is a schematic drawing showing a plan view with portions broken away of another first post or anchor post with attached cables satisfactory for use with a crash cushion incorporating teachings of the present invention.
Figure 4B:
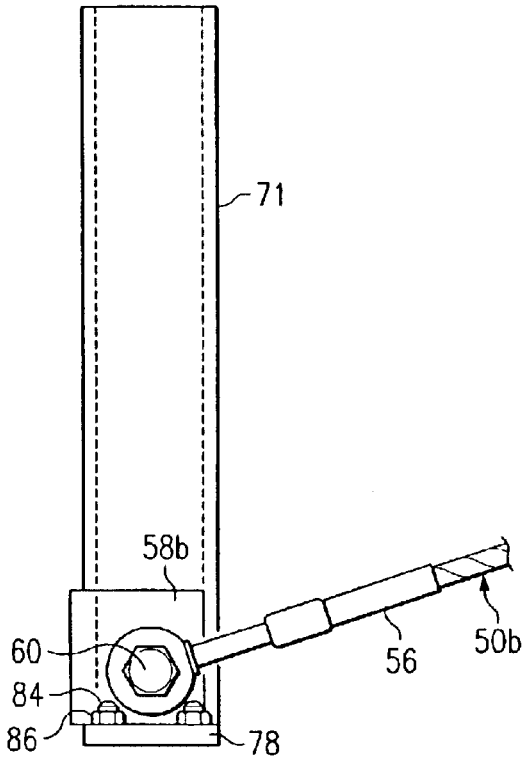
FIG. 4B is a schematic drawing in elevation with portions broken away of the first post or anchor post shown in FIG. 4A.
Figure 5B:
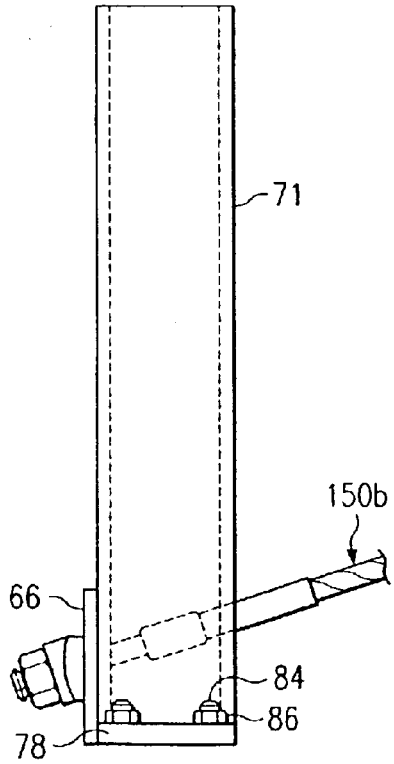
FIG. 5B is a schematic drawing in elevation with portions broken away of the first post or anchor post of FIG. 5A.

As shown in FIGS. 4A and 4B, cable anchor assemblies 50*a* and 50*b* include a respective eye bolt 56 attached to cables 52*a* and 52*b*. Respective reinforcing plates or support plates 58*a* and 58*b* are preferably disposed on opposite sides of support post 71 adjacent to base plate 78. Openings (not expressly shown) are preferably placed in support plates 58*a*, 58*b* and adjacent portions of support post 71. One end of cable anchor assemblies 50*a* and 50*b* may be attached with support post 71 by inserting bolt 60 through eye bolt 56 and corresponding openings in support plates 58*a*, 58*b* and support post 71. Nut 62 may be used to secure eye bolts 56 and associated cable anchor assemblies 50*a* and 50*b* with bolt 60. Various types of mechanical fasteners may be satisfactorily used to attach cable anchor assemblies 50*a* and 50*b* with support post 71. The present invention is not limited to use with bolt 60 and nut 62. Cable anchor assemblies 150*a* and 150*b* incorporating teachings of the present invention are shown in FIGS. 5*a* and 5*b*. For this embodiment, cables 52*a* and 52*b* preferably extend through holes (not expressly shown) formed in post 71 adjacent to base plate 78. The extreme end of each cable 52*a* and 52*b* preferably includes respective threaded fittings 64 which may be extended through holes (not expressly shown) in post 71 and support plate 66. Respective nuts 68 may be engaged with threaded fittings 64 to secure cables 52*a* and 52*b* with post 71. Support plate 66 may be disposed between nuts 68 and adjacent portions of post 71.

Figure 6A:
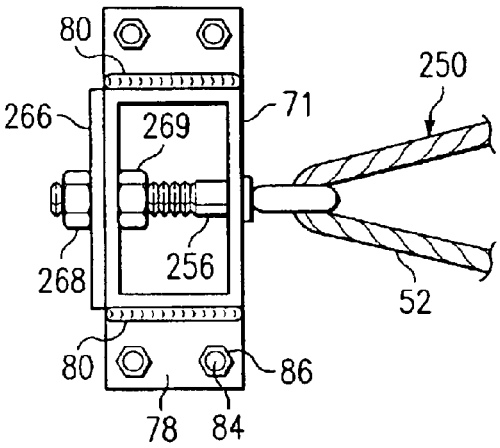
FIG. 6A is a schematic drawing showing a plan view with portions broken away of still another first post or anchor post with attached cables satisfactory for use with a crash cushion incorporating teachings of the present invention.
Figure 6B:
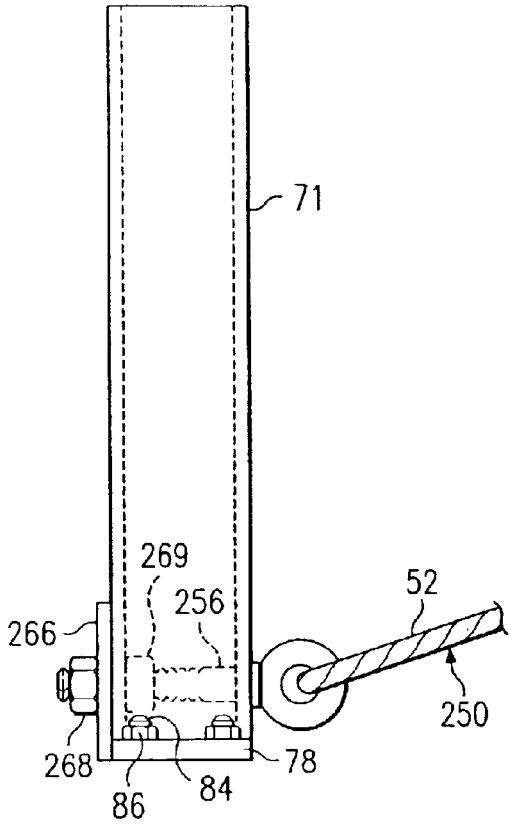
FIG. 6B is a schematic drawing in elevation with portions broken away of the first post or anchor post of FIG. 6A.

Cable anchor assembly 250 incorporating teachings of the present invention is shown in FIGS. 6A and 6B. For this embodiment of the present invention cable anchor assembly 250 includes a single cable 52 which is threaded through the eye of eye bolt 256. Holes (not expressly shown) are preferably formed in and extend through support post 72 adjacent to base plate 78. Support plate or bearing plate 266 may also be disposed adjacent to post 71 and base plate 78. A corresponding hole (not expressly shown) also extends through support plate 266. Eye bolt 256 extends through these holes and may be secured with support post 71 and support plate 266 by one or more nuts 268 and 269. Various types of mechanical fasteners other than eye bolt 256 and nuts 268 and 269 may be satisfactorily used to secure cable anchor assembly 250 with support post 71. The present invention is not limited to use with eye bolt 256 and nuts 268, and 269.

Figure 7:
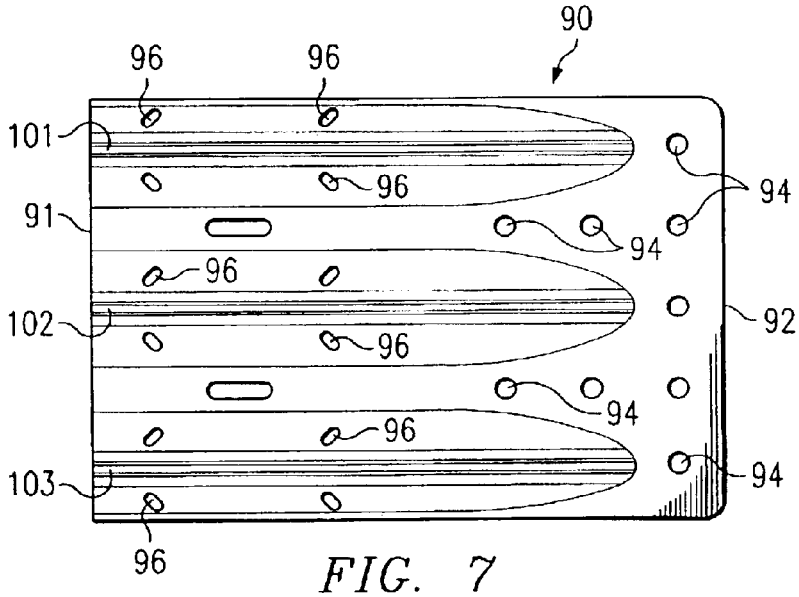
FIG. 7 is a schematic drawing in elevation showing a connector which may be satisfactorily used to attach a crash cushion with one end of a traffic barrier in accordance with teachings of the present invention.

One example of a beam connector satisfactory for use with an energy absorbing device formed in accordance with teachings of the present invention is shown in FIG. 7. Beam connector 90 may be satisfactorily used as beam connectors 90*a* and 90*b* shown in FIGS. 1 and 2. First end 91 of beam connector 90 preferably has a cross section corresponding with the cross section of associated energy absorbing members 30. Second end 92 of beam connector 90 preferably has a generally flat configuration. For the embodiment of the present invention as shown in FIG. 7, a plurality of bolts (not expressly shown) may be disposed in holes 94 to securely engage beam connector 90 with traffic barrier 130. A plurality of openings 96 are provided in each crown 101, 102 and 103. Bolts or other suitable fasteners 95 may be engaged with openings 96 and corresponding slots 34*a*–34*f* formed adjacent to end 32 of an associated energy absorbing member 30.

Figure 2:
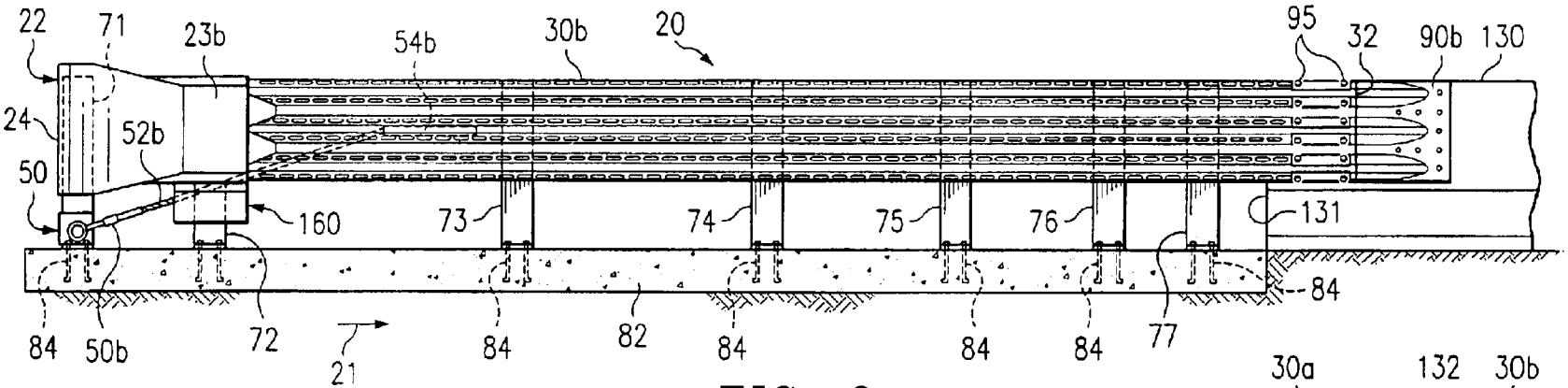
FIG. 2 is a schematic drawing with portions broken away showing an elevational view of the crash cushion of FIG. 1.
Figure 8:
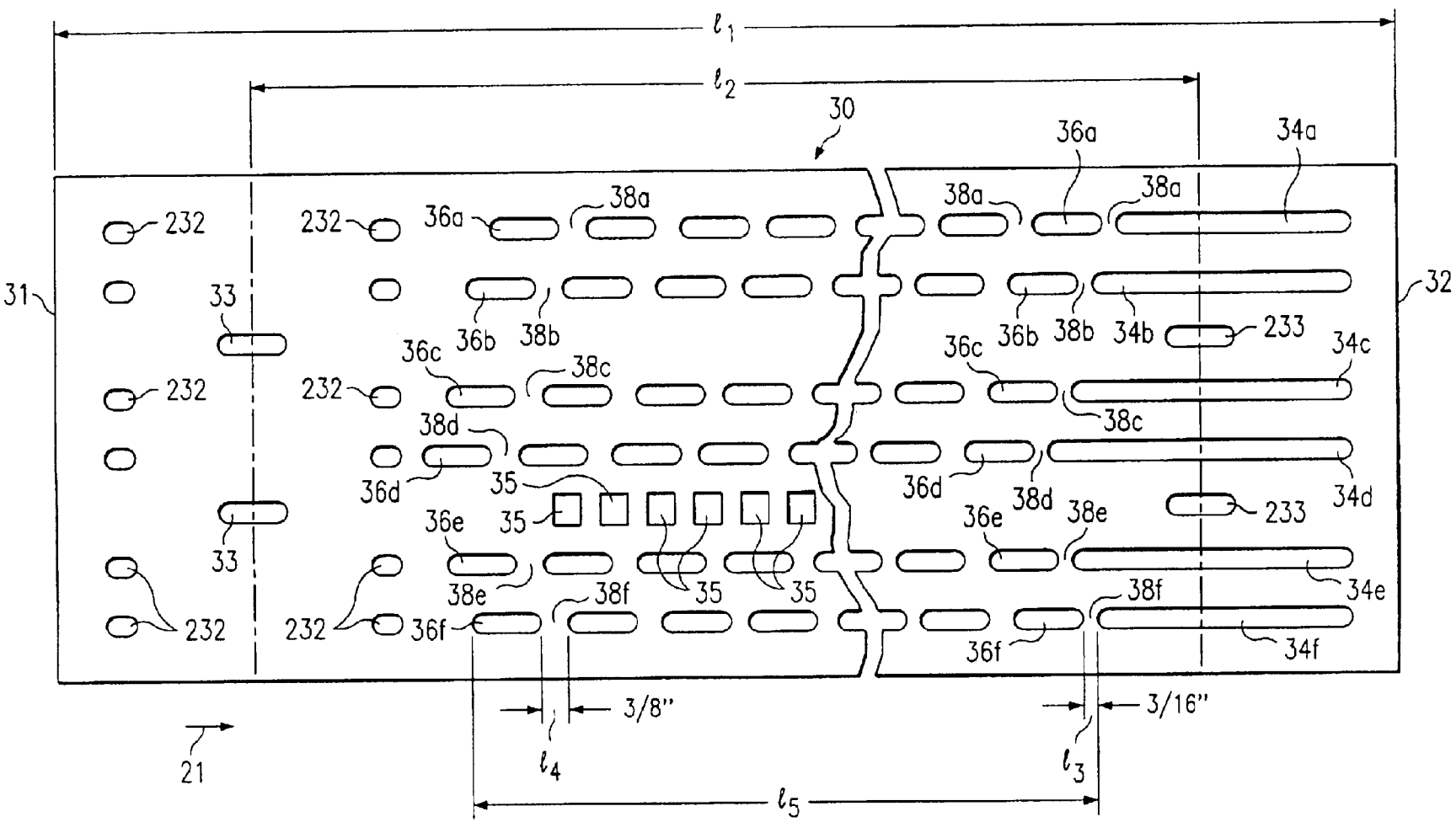
FIG. 8 is schematic drawing with portions broken away showing an elevational view of spaced openings and lands formed in a thrie beam to absorb impact energy in accordance with teachings of the present invention.

FIG. 8 is a schematic drawing showing an elevational view of a slot and land pattern formed in energy absorbing member 30 in accordance with teachings of the present invention. For some applications absorbing member 30 may have the general configuration and dimensions associated with a typical thrie beam guardrail section. For example the location and dimensions associated with slots or openings 33, 232 and 233 may correspond with dimensions and locations of similar openings or slots associated in a conventional thrie beam guardrail section. Slots 33 formed adjacent to first end 31 may be used to securely attach energy absorbing member 30 with second support post 72. See FIGS. 9 and 10. Referring to FIGS. 2 and 14, a plurality of slots 34*a*–34*f* may be formed adjacent to second end 32 for use in slidably attaching energy absorbing member 30 with an associated beam connector 90. A plurality of openings 35 may also be formed in energy absorbing member 30 for use in releasably attaching respective cable anchor bracket 54*a* or 54*b* thereto.

Figure 3:
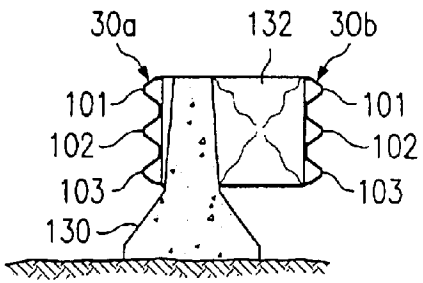
FIG. 3 is a schematic drawing in section taken along lines 3—3 of FIG. 1.

As shown in FIGS. 3, 7 and 14, energy absorbing member 30 and portions of associated beam connector 90 preferably have substantially the same general cross section defined in part by crowns 101, 102 and 103. For purposes of illustrating various features of the present invention, crowns 101, 102 and 103 are not shown in FIG. 8. As shown in FIGS. 1, 2 and 14, end 32 of each energy absorbing member 30 may be disposed on the exterior of associated beam connector 90 overlapping corresponding crowns 101, 102 and 103. A plurality of bolts 95 or other suitable fasteners may be respectively disposed within slots 34*a*–34*f* of energy absorbing member 30 and respective holes 96 formed in associated beam connector 90. For some applications, a total of twelve (12) bolts may be satisfactorily used to slidably secure end 32 of energy absorbing member 30 with an associated beam connector 90.

A plurality of respective openings or slots 36*a*–36*f* are preferably disposed adjacent to and aligned with respective slots 34*a*–34*f*. Respective openings or slots 36*a*–36*f* extend longitudinally along beam 30. As shown in various drawings such as FIG. 10, slots 36*a* and 36*b* may be formed in opposite sides of crown 101. Slots 36*c* and 36*d* may be formed in opposite sides of crown 102 and slots 36*e* and 36*f* in opposite sides of crown 103. A plurality of lands or metal strips respectively designated as 38*a*–38*f* are preferably disposed between each associated slot 36*a*–36*f*. An energy absorbing device may be formed in accordance with teachings of the present invention with one or more energy absorbing members having a wide variety of slot and land patterns. The present invention is not limited to energy absorbing members having a pattern corresponding with slots 36*a*–36*f* and lands 38*a*–38*f*. The present invention is also not limited to energy absorbing members, which are formed from metal.

For the embodiment shown in FIG. 8, respective slots 36*a*–36*f* and associated lands 38*a*–38*f* may be generally described as forming a staggered offset pattern. Each set of slots 36*a*–36*f* and associated lands 38*a*–38*f* are preferably aligned with respective slots 34*a*–34*f* such that bolts disposed within corresponding openings 96 will engage respective lands 38*a*–38*f* as energy absorbing member 30 slides longitudinally relative to beam connector 90.

For some applications, energy absorbing member 30 may be formed from ten (10) gauge steel alloys associated with highway guardrail systems. For other applications, energy absorbing member 30 may be formed from twelve (12) gauge steel alloys. The thickness of the material used to form energy absorbing members 30 may be varied to provide desired impact energy absorbing characteristics.

For the embodiment of the present invention as shown in FIGS. 1–14, beam 30 may have an overall length ($l_1$) may be approximately nineteen (19) feet. The longitudinal spacing ($l_2$) between the midpoint of slots 33 and the midpoint of slots 233 may be approximately eighteen (18) feet. The configuration, location and dimensions associated with slots 33 and slots 233 may correspond generally with a conventional thrie beam guardrail section.

The length of each land 38*a*–38*f* may vary along the length of energy absorbing member 30. For the embodiment of the present invention shown in FIG. 8, land 38*f* immediately adjacent to slot 34*f* may have a length ($l_3$) of approximately three-sixteenths (3/16) of an inch. Land 38*f* disposed adjacent to end 31 may have a length ($l_4$) of approximately three-eighths (3/8) of an inch. Varying the length of slots 38*a*–38*f* allows controlling deceleration of a vehicle that impacts with nose assembly 21 of crash cushion 20 or the end of crash cushion 20 facing oncoming traffic. The overall length of slots 34*a*–34*f* and respective slots 36*a*–36*f* may vary. For example, length ($l_5$) between slot 34*f* and slot 36*f* located proximate end 31 may be approximately seventeen feet. Slots 36*a*–36*f* may have a generally oval shaped configuration defined in part by a length of approximately three inches and a width of approximately seven-eighths of an inch. However, other slot or opening configurations may be used.

Respective blocks 100*a* and 100*b* may be attached on opposite sides of each support post 72–77. See FIGS. 1, 9 and 12. Blocks 100*a* and 100*b* may be formed from composite or plastic materials with substantially the same configuration and dimension. For other applications blocks 100*a* and 100*b* may be formed from a wide variety of other materials such as wood, metal, elastomeric materials including but not limited to recycled rubber. Also, for some applications the dimensions and configurations of each block 100*a* and 100*b* may vary along the length of the associated crash cushion. For still other applications it may not be necessary to attach any blocks with the support post or one block may be attached to one side of each support post. Blocks 100*a* and 100*b* may be used as required to maintain desired spacing between energy absorbing members 30*a* and 30*b*. Various types of mechanical fasteners may be used to attach blocks 100*a* and 100*b* with respective posts 72–77. The present invention is not limited to use with blocks 100*a* and 100*b*.

Second post 72 and impact assembly 160 are shown in more detail in FIGS. 9, 10 and 11 with nose assembly 22 removed. As previously noted, crash cushion 20 may be satisfactorily formed in accordance with teachings of the present invention without a nose assembly. Energy absorbing members 30*a* and 30*b* are preferably securely attached with support post 72. As discussed later in more detail, energy absorbing members 30*a* and 30*b* are preferably slidably coupled with support post 73–77. For the embodiment of the present invention as shown in FIGS. 9 and 10, a pair of bolts 98 extend through respective holes or slots 33 formed in each energy absorbing member 30*a* and 30*b* proximate ends 31. Corresponding holes 99 may be formed in blocks 100*a*, 100*b* and post 72 to receive bolts 98. A respective nut 100 may be attached with the end of each bolt 98 extending through energy absorbing member 30*a*. A wide variety of mechanical fasteners may be satisfactorily used to securely attach energy absorbing members 30*a* and 30*b* with second support post 72. The present invention is not limited to use with bolts 98 or nuts 100.

Many vehicles on today's highways are reasonably configured for a head-on impact with an energy absorbing device formed in accordance with teachings of the present invention. The bumper, engine and/or engine compartment generally provide adequate structure for engagement with the end of the energy-absorbing device facing oncoming traffic to allow desired energy absorption without unduly damaging or impinging upon the passenger compartment. For example, during most head-on collisions or impacts with the end of crash cushion 20 facing oncoming traffic, energy will be transferred from the impacting vehicle to support post 72 and energy absorbing members 30*a* and 30*b*.

The configuration of post 72, attached blocks 100*a* and 100*b* respective ends 31, or energy absorbing 30*a* and 30*b*, along with bolts 98 form a relatively strong impact structure for the transfer of energy from an impacting vehicle to energy absorbing members 30*a* and 30*b*. However, many vehicles currently in use on today's highways have only a minimal structure along the sides of the vehicles. Also, some vehicles have a relatively low front bumper profile, which may not satisfactorily engage post 72 and ends 31 of energy absorbing members 30*a* and 30*b*. Therefore, impact assembly 160 may be attached with the lower portion of second post 72 to provide a system for transferring energy from a floor structure of a vehicle during a side impact with the end of crash cushion 20 facing oncoming traffic. Impact assembly 160 may also assist with transferring energy when a vehicle having a low front bumper profile during head on impacts with the end of crash cushion 20 facing oncoming traffic.

For the embodiment of the present invention as shown in FIGS. 9, 10 and 11, impact assembly 160 may be formed from an elongated rectangular metal sheet 62 and a generally c-shaped channel member 172. For some applications, rectangular opening 164 may be formed at approximately the mid-point of metal sheet 162. For other applications, opening 164 may have a generally U-shaped configuration extending to one edge of metal sheet 162. The dimensions associated with opening 164 are preferably selected to be compatible with the exterior dimensions of second support posts 72. Respective ninety degree (90°) bends may be formed in metal sheet 162 between opening 164 and respective ends 163 and 165. The longitudinal spacing between the ninety degree (90°) bends are preferably selected to be approximately equal with the width of block 100*a*, second support post 72 and block 100*b* when attached with each other. Additional bends of approximately fifty-five degrees (55°) may also be formed between each ninety degree (90°) bend 166 and respective ends 163 and 165. As a result of bends 168, respective tapered surfaces 170*a* and 170*b* may be formed on and extend from impact assembly 60.

The dimensions and configuration of tapered surfaces 170*a* and 170*b* are preferably selected to be compatible with adjacent portions of energy absorbing members 30*a* and 30*b*. A pair of holes 172 may be formed in each tapered surface 170*a* and 170*b* for use in attaching energy absorbing members 30*a* and 30*b* with impact assembly 160. Respective bolts 174 and nuts 176 may be used to securely engage impact assembly 160 with energy absorbing members 30*a* and 30*b*. Various types of mechanical fasteners and/or welds may be satisfactorily used to attach an impact assembly with energy absorbing members formed in accordance with teachings of the present invention. The present invention is not limited to use with bolts 174 and nuts 176. C-shaped channel 182 may be attached with metal sheet 162 using welding techniques and/or mechanical fasteners as desired.

Figure 13:
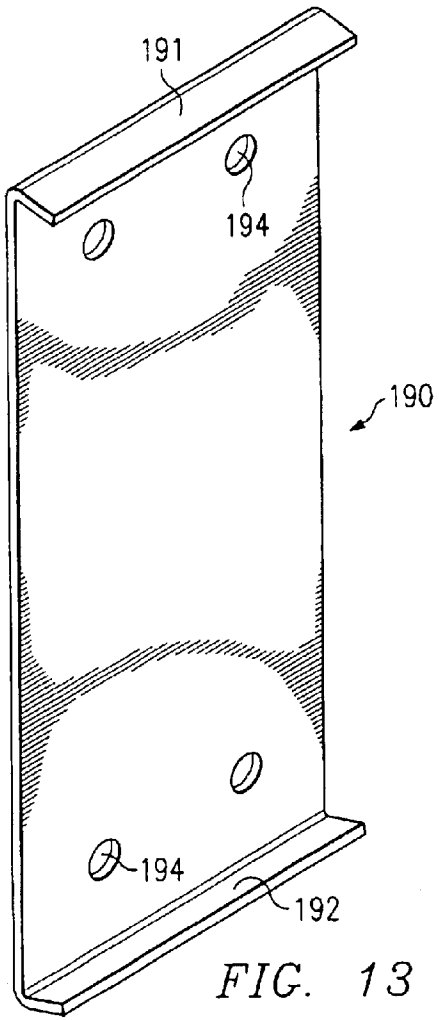
FIG. 13 is a schematic drawing showing an isometric view of a clip which may be satisfactorily used to slidably couple a beam with a support post in accordance with teachings of the present invention.

Energy absorbing members 30*a* and 30*b* are preferably slidably attached with support posts 73 through 77 without any restraint. For some applications, guide plates 190 such as shown in FIGS. 12 and 13 may be respectively secured with blocks 100*a* and 100*b*. For this embodiment of the present invention guide plates 190 may be formed from a generally elongated rectangular sheet of metal. Ends 191 and 192 of guide plate 190 are preferably bent to form a cross section which is compatible with allowing sliding movement of energy absorbing members 30*a* and 30*b* therethrough. For some applications ends 191 and 192 may be bent to form a generally trapezoidal shaped cross section. A plurality of holes 194 may also be formed in each guide plate 190 for use in attaching respective guide plates 190 with blocks 100*a* and 100*b*. As shown in FIG. 12, bolts 196 and nuts 198 may be satisfactorily used to secure a pair of guide plates 190 on opposite sides of support posts 77 with blocks 100*a* and 100*b* disposed therebetween.

When a vehicle impacts with nose assembly 22 or the upstream end of crash cushion 20, beams 30*a* and 30*b* may move downstream relative to highway barrier 130 causing bolts 95 attached through slots 96 using flat washers 97 to shred lands 38*a*–38*f* disposed between respective openings 36*a*–36*f*. In some embodiments, flat washer 97 may be formed to attach two bolts 95 for shredding of lands 38*a*–38*f*. The shredding of lands 38*a*–38*f* may absorb kinetic energy of the impacting vehicle. Therefore, lands 38*a*–38*f* may engage the bolts 95 until the kinetic energy of the impacting vehicle has been absorbed. According to one aspect of the invention, the staggered or offset pattern of slots 36*a*–36*f* and lands 38*a*–38*f* may be varied to minimize variations in force during absorption of the kinetic energy.

Fasteners or bolts 95 may be positioned in slots 36*a*–36*f* of beams 30*a* and 30*b*. It can be seen that if fasteners or bolts 95 and flat washers 97 are held in a fixed position while beams 30*a* and 30*b* are moved in the direction of arrow 21, bolts will shred metal portions between slots in a continuous pattern (i.e., one bolt is shredding metal at any given time during the shredding process.)

When a vehicle impact occurs with nose assembly 22, sufficient kinetic energy will be applied to break away or release first support post 71. Cable anchor assemblies 50*a* and 50*b* will be released when first support post 71 breaks away. An impacting vehicle will then contact second support post 72 and impact assembly 160. As previously discussed, kinetic energy from the impacting vehicle may be transferred from support post 71 and impact assembly 160 to energy absorbing members 30*a* and 30*b*. Second support post 72 will also break away as a result of the vehicle impact and disengage cable anchor brackets 54*a* and 54*b* from energy absorbing members 30*a* and 30*b*. Energy absorbing members 30*a* and 30*b* may then telescope or move relative to first end 31 of highway barrier 30 which will initiate shredding of lands 38*a*–38*f* by bolts (not expressly shown) which are securely engaged with respective beam connectors 90. The staggered, offset pattern associated with slots 36*a*–36*f* and lands 38*a*–38*f* may result in sequential shredding of lands 38*a*–38*f* and increased energy absorption. As previously noted, lands 38*f* adjacent to slots 34*a*–34*f* may have a relatively short length which results in a relatively low amount of energy absorption as energy absorbing members 30*a* and 30*b* telescope relative to highway barrier 30. Since the length of lands 38*a*–38*f* increases from second end 32 towards first end 31, additional increments of kinetic energy may be absorbed from the impacting vehicle as energy absorbing members 30*a* and 30*b* telescope relative to highway barrier 130.

For one application, the shredding of material may begin with lands 38*a* and 38*f* disposed immediately adjacent to slots 34*a* and 34*f*. The pattern of shredding lands 34*a* through 34*f* will proceed as shown in FIG. 8. Nearly continuous shredding of lands 38*a*–38*f* will occur during a vehicle impact and the amount of energy absorbed will also increase substantially as first end 31 or energy absorbing members 30*a* and 30*b* telescopes relative to end 131 of highway barrier 130.

For embodiments of the present invention as shown in FIGS. 1–16, energy absorbing members 30*a* and 30*b* may be formed with substantially the same configuration using the same materials as standard thrie beams associated with highway guardrail systems. For other applications energy absorbing members may be formed with substantially the same configuration using the same materials as standard W-beams (not expressly shown). For many applications energy absorbing members 30*a* and 30*b* may be formed from substantially the same material with the same overall dimensions and configurations. Also, the same general pattern of openings may be formed in each energy absorbing member as shown by energy absorbing members 30*a* and 30*b*. However, for some applications energy absorbing members, which are not identical, may be used to form an energy absorbing device in accordance with teachings of the present invention. For example, one energy absorbing member may have the general configuration of a thrie beam and another energy absorbing member may have the general configuration of a W-beam. Also, the pattern of openings may vary between one energy absorbing member and an associated energy absorbing member.

For some applications, an energy absorbing device may be formed in accordance with teachings of the present invention using wooden posts (not expressly shown) which may be mounted in metal tubes (not expressly shown) to assist in breaking the wooden post at ground level. One or more holes (not expressly shown) may be formed in such wooden posts to provide desired breakaway characteristics. Posts satisfactory for use with the present invention may be made from wood or any other suitable breakaway material. The types of material which may be satisfactorily used to manufacture posts with desired strength and/or breakaway characteristics appropriate for an energy absorbing system formed in accordance with teachings of the present invention include but are not limited to wood, steel, plastic materials, composite materials and various types of plastics.

For some applications a steel foundation tube (not expressly shown) may be placed in the ground adjacent to the shoulder of a roadway (not expressly shown) at a desired location for the associated energy absorbing device. The posts may be inserted into respective foundation tubes. Various techniques which are well known in the art may be used to satisfactorily install foundation tubes and/or posts depending upon the type of soil conditions and other factors associated with the roadway and hazard requiring installation of the associated energy absorbing system. In addition to foundation tubes other types of post-to-ground installation systems such as concrete with steel slit base posts and direct drive breakaway posts may be satisfactorily used with an energy absorbing system incorporating teachings of the present invention. For the embodiment represented by crash cushion 20, seven support posts may be used. For other applications, the number of support posts may be varied depending upon the length of the associated energy absorbing system and the hazard or traffic barrier associated therewith.

A wide variety of support posts and breakaway mechanisms may be satisfactorily used to form an energy absorbing device in accordance with teachings of the present invention. For some applications, a plurality of breakaway bolts may be used to attach support posts with an associated foundation. For other applications, breakaway mechanisms may be used to provide satisfactory support posts. The present invention is not limited to use with posts 71–79.

Although the present invention and its advantages have been described in detail, it should be understood that various changes, substitutions, and alterations can be made therein without departing from the spirit and scope of the invention as defined by the appended claims.

What is claimed is:

1. An energy absorbing device comprising:

at least two energy absorbing members extending substantially parallel to one another;

each energy absorbing member includes a first end spaced from a traffic barrier and a second end slidably attached to the traffic barrier;

a plurality of support posts coupled to and supporting the energy absorbing members;

the first end of at least two of the energy absorbing members securely attached with one of the support posts proximate a first end of the energy absorbing device;

a plurality of fasteners slidably coupling the respective second end of the energy absorbing members to the traffic barrier; and a plurality of openings and lands formed in the energy absorbing members to encounter the plurality of fasteners during impact of a vehicle with the first end of the energy absorbing device to dissipate a substantial amount of energy of an impacting vehicle by shredding lands.

2. The energy absorbing device of claim 1 wherein the plurality of energy absorbing members comprises at least one thrie beam.

3. The energy absorbing device of claim 1 wherein the plurality of energy absorbing members comprises at least one W-beam.

4. The energy absorbing device of claim 1 further comprising:

respective sets of openings and lands extending generally longitudinally along the length of each energy absorbing member;

each set of lands and openings spaced laterally from each other;

the length of each land closest to the second end of each energy absorbing member having a first value; and each land in the series after the first land having a length greater than the length of the first land.

5. The energy absorbing device of claim 1 further comprising the openings and lands in the energy absorbing members registered with the plurality of fasteners such that during an impact of a vehicle with the first end of the energy absorbing members at least one fastener shreds a portion of at least one energy absorbing member at any given time during energy dissipation.

6. The energy absorbing device of claim 1 further comprising:

the lands defined in part by intermediate material disposed between the openings formed in the energy absorbing members;

each land having a length; and the respective length of the lands varying between the first end and the second end of the energy absorbing members.

7. The energy absorbing device of claim 1 wherein the traffic barrier comprises a concrete barrier having a first end facing oncoming traffic along at least one side of the energy absorbing device.

8. The energy absorbing device of claim 1 further comprising:

a respective connector for slidably coupling the second end of each energy absorbing member with the traffic barrier; and the plurality of fasteners secured to respective connectors and registered with respective openings of the energy absorbing members such that during impact of a vehicle with the first end of the energy absorbing member, the fasteners shred portions of the lands disposed between adjacent openings to dissipate energy of the impacting vehicle.

9. The energy absorbing device of claim 1 further comprising:

a first cable and a second cable attached with one of the support posts proximate a first end of the energy absorbing device;

a first cable anchor bracket releasably attaching the first cable with one of the energy absorbing members; and a second cable anchor bracket releasably attaching the second cable with the other energy absorbing members.

10. A crash cushion comprising:

a pair of beams spaced from each other and extending substantially parallel to each other;

each beam having approximately an equal length with a first end and a second end operable to be slidably coupled with a traffic barrier;

at least one breakaway support post securely attached to and supporting the first end of the beams;

additional breakaway support posts disposed between the first end of the beams and the second end of the beams;

a plurality of fasteners operable to slidably couple the second end of the beams to a traffic barrier;

a plurality of openings and lands formed in the beams; and the openings and lands aligned with respective fasteners whereby the plurality of fasteners encounter the lands during a forceful impact of a vehicle with the at least one second breakaway support post to dissipate a substantial amount of energy by shredding lands.

11. The crash cushion of claim 10, wherein the pair of beams comprise thrie beams.

12. The crash cushion of claim 10 wherein the pair of beams comprise W-beams.

13. The crash cushion of claim 10 further comprising an impact assembly attached to the at least one breakaway support post at the first end of the beams and sized for engagement with an impacting vehicle.

14. The crash cushion of claim 10 further comprising:

a first cable and a second cable, each having a respective first end and a second end;

the first end of each cable releasably anchored proximate the first end of the beams;

a first cable anchor bracket releasably attaching the second end of the first cable with one of the pair of beams; and a second cable anchor bracket releasably attaching the second end of the second cable with the other of the pair of beams.

15. The crash cushion of claim 10 further comprising the pair of beams slidably coupled with at least one of the breakaway support posts.

16. A method of forming a crash cushion:

forming at least two beams with each beam having a first end and a second end;

forming a plurality of openings and a plurality of lands disposed between adjacent openings extending between the first end and the second end of each beam;

forming the openings and lands in respective rows aligned generally longitudinal with each other;

varying the length of the lands in each row between the first end and the second end of the beams;

positioning the first end of the beams extending from one end of a traffic barrier;

slidably attaching the second end of the beams with the traffic barrier using a plurality of fasteners respectively aligned with each row of openings and lands; and slidably coupling the plurality of beams with a plurality of breakaway support posts spaced from the one end of the traffic barrier whereby energy from a vehicle forcefully impacting one end of the crash cushion opposite from the traffic barrier will be dissipated by the fasteners shredding the lands of the beams.

* * * * *